US010026359B2

(12) United States Patent
Chae et al.

(10) Patent No.: US 10,026,359 B2
(45) Date of Patent: Jul. 17, 2018

(54) GAMMA VOLTAGE GENERATOR, METHOD OF GENERATING GAMMA VOLTAGE, AND ORGANIC LIGHT-EMITTING DIODE DISPLAY INCLUDING THE GENERATOR

(71) Applicant: Samsung Display Co., Ltd., Yongin-si, Gyeonggi-do (KR)

(72) Inventors: Sebyung Chae, Yongin-si (KR); Hyungryul Kang, Yongin-si (KR); Cheolmin Kim, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 344 days.

(21) Appl. No.: 14/849,248

(22) Filed: Sep. 9, 2015

(65) Prior Publication Data

US 2016/0133192 A1 May 12, 2016

(30) Foreign Application Priority Data

Nov. 10, 2014 (KR) ..... 10-2014-0155524

(51) Int. Cl.
*G09G 3/32* (2016.01)
*G09G 3/3258* (2016.01)

(52) U.S. Cl.
CPC ... *G09G 3/3258* (2013.01); *G09G 2320/0276* (2013.01); *G09G 2320/0673* (2013.01); *G09G 2360/145* (2013.01)

(58) Field of Classification Search
CPC ... G09G 2320/0276; G09G 2320/0673; G09G 2360/145; G09G 3/3258
See application file for complete search history.

(56) References Cited

U.S. PATENT DOCUMENTS

2007/0046600 A1* 3/2007 Sun ..... G09G 3/3688 345/89
2009/0201275 A1* 8/2009 Bae ..... G09G 3/2011 345/208

(Continued)

FOREIGN PATENT DOCUMENTS

KR 10-2013-0058496 A 6/2013
KR 10-2013-0081451 A 7/2013

(Continued)

*Primary Examiner* — Ariel Balaoing
(74) *Attorney, Agent, or Firm* — Knobbe, Martens, Olson & Bear, LLP

(57) ABSTRACT

A gamma voltage generator, method of generating gamma voltage, and an OLED display including the generator are disclosed. In one aspect, the generator includes a gamma reference voltage selector configured to receive a gamma reference voltage from a voltage generator and output selected first to third gamma voltages having values substantially equal to or less than the gamma reference voltage. The generator also includes a medium gamma voltage selector configured to receive the first to third gamma voltages from the gamma reference voltage selector and select and output a plurality of medium gamma voltages based at least in part on the first to third gamma voltages. The generator further includes a medium gamma voltage calculator configured to output a selection signal corresponding to the calculated low gamma voltage to the medium gamma voltage selector.

20 Claims, 7 Drawing Sheets

(56) References Cited

U.S. PATENT DOCUMENTS

| | | | | |
|---|---|---|---|---|
| 2009/0213055 | A1* | 8/2009 | Chung | G09G 3/20 345/89 |
| 2013/0135272 | A1* | 5/2013 | Park | G09G 3/3233 345/211 |
| 2013/0176349 | A1 | 7/2013 | Park et al. | |
| 2013/0249955 | A1 | 9/2013 | Kim et al. | |
| 2014/0125567 | A1 | 5/2014 | Hong et al. | |
| 2014/0320546 | A1* | 10/2014 | Lim | G09G 3/3291 345/690 |

FOREIGN PATENT DOCUMENTS

| | | | |
|---|---|---|---|
| KR | 10-2013-0108822 | A | 10/2013 |
| KR | 10-2014-0058966 | A | 5/2014 |

* cited by examiner

| Gray | LUMINANCE(Nit) | VOLTAGE(V) |
|---|---|---|
| 0 | 0.005 | 6.0 |
| 3 | 0.01708 | 5.437 |
| 11 | 0.29771 | 5.253 |
| 23 | 1.50846 | 5.064 |
| 35 | 3.79912 | 4.952 |
| 51 | 8.69736 | 4.846 |
| 87 | 28.1628 | 4.659 |
| 151 | 94.7288 | 4.461 |
| 203 | 181.645 | 4.316 |
| 255 | 300 | 4.175 |

GAMMA VOLTAGE GENERATOR, METHOD OF GENERATING GAMMA VOLTAGE, AND ORGANIC LIGHT-EMITTING DIODE DISPLAY INCLUDING THE GENERATOR

RELATED APPLICATION

This application claims the benefit of Korean Patent Application No. 10-2014-0155524, filed on Nov. 10, 2014, in the Korean Intellectual Property Office, the disclosure of which is incorporated herein in its entirety by reference.

BACKGROUND

Field

The described technology generally relates to a gamma voltage generator, a method of generating gamma voltage, and an organic light-emitting diode display including the generator.

Description of the Related Technology

A gamma voltage generator in a display device generates grayscale voltages, in which a gamma characteristic of the display panel is reflected, and supplies the grayscale voltages to a data driver. The data driver selects a grayscale voltage, corresponding to digital data, from among the grayscale voltages and applies the selected grayscale voltage to each pixel of the display panel.

SUMMARY OF CERTAIN INVENTIVE ASPECTS

One inventive aspect is a gamma voltage generator, a method of generating gamma voltage, and an organic light-emitting diode (OLED) display including the generator, which generates a gamma voltage that enables light, having luminance close to target luminance, to be emitted in a low gray scale.

Another aspect is a gamma voltage generator for supplying gamma voltages based on a gamma characteristic of a display panel that includes: a gamma reference voltage selector that receives a gamma reference voltage to select and output a first gamma voltage, a second gamma voltage, and a third gamma voltage which have a value that is equal to or less than the gamma reference voltage; a medium gamma voltage selector that receives the first to third gamma voltages to select and output a plurality of medium gamma voltages; and a medium gamma voltage calculator that receives a plurality of high gamma voltages corresponding to a high gray scale from the medium gamma voltage selector, selects some of the plurality of high gamma voltages to calculate a low gamma voltage corresponding to a low gray scale, and outputs a selection signal corresponding to the calculated low gamma voltage to the medium gamma voltage selector.

The low gamma voltage can include a voltage corresponding to a gray scale "0" and a voltage corresponding to a gray scale "3".

The gamma reference voltage selector can include a resistor string, in which a plurality of resistors are connected to each other in series, and first to third selectors.

The medium gamma voltage selector can include: a plurality of sub resistor strings; and a plurality of sub-selectors that respectively match the plurality of sub resistor strings and select and output a medium gamma voltage from among voltages divided by the plurality of sub resistor strings according to the selection signal.

The plurality of sub resistor strings can include a first sub resistor string that generates a plurality of medium gamma voltages corresponding to a gray scale "0", and the first sub resistor string can receive the gamma reference voltage and a second reference voltage to generate a plurality of medium gamma voltages having a value between the gamma reference voltage and the second reference voltage.

In the above gamma voltage generator, the medium gamma voltage calculator can calculate the low gamma voltage by using the following Equation:

$$V = 5.481 - \left(\frac{L}{6.1}\right)^{1/2}$$

where V denotes the low gamma voltage and L denotes a luminance value corresponding to a corresponding gray scale.

The medium gamma voltage calculator can output a first selection signal for selecting a gamma voltage corresponding to a gray scale "0" and a second selection signal for selecting a gamma voltage corresponding to a gray scale "3".

The gamma voltage generator can further include a grayscale voltage generator that voltage-divides the plurality of medium gamma voltages to generate a plurality of grayscale voltages.

The grayscale voltage generator can voltage-divide the plurality of medium gamma voltages through a plurality of serially connected resistors to generate the plurality of grayscale voltages.

Another aspect is an OLED display that includes: the gamma voltage generator; a display panel that includes a plurality of pixels; and a data driver that receives a plurality of grayscale voltages from the gamma voltage generator to respectively supply data signals, corresponding to an image which is to be displayed by the display panel, to the plurality of pixels.

Another aspect is a gamma voltage generating method of supplying gamma voltages based on a gamma characteristic of a display panel that includes: measuring a luminance of the display panel and determining a plurality of high gamma voltages corresponding to a high gray scale; selecting at least two high gamma voltages from among the plurality of high gamma voltages; and calculating a low gamma voltage by using the selected at least two high gamma voltages.

The low gamma voltage can include a voltage corresponding to a gray scale "0" and a voltage corresponding to a gray scale "3".

The calculating of the low gamma voltage can include calculating the low gamma voltage by using the following Equation:

$$V = 5.481 - \left(\frac{L}{6.1}\right)^{1/2}$$

where V denotes the low gamma voltage and L denotes a luminance value corresponding to a corresponding gray scale.

The gamma voltage generating method can further include voltage-dividing the plurality of high gamma voltages and the low gamma voltage to generate a plurality of gray voltages.

Another aspect is a gamma voltage generator for an organic light-emitting diode (OLED) display, comprising a gamma reference voltage selector configured to i) receive a gamma reference voltage from a voltage generator, ii) select first to third gamma voltages from a plurality of gamma voltages based at least in part on the gamma reference voltage, and iii) output the selected first to third gamma voltages having values substantially equal to or less than the gamma reference voltage. The gamma voltage generator also comprises a medium gamma voltage selector configured to i) receive the first to third gamma voltages from the gamma reference voltage selector and ii) select and output a plurality of medium gamma voltages based at least in part on the first to third gamma voltages. The gamma voltage generator also comprises a medium gamma voltage calculator configured to i) receive a plurality of high gamma voltages, corresponding to a high gray scale, from the medium gamma voltage selector, ii) select at least one of the high gamma voltages based at least in part on the first to third gamma voltages so as to calculate a low gamma voltage corresponding to a low gray scale, and iii) output a selection signal corresponding to the calculated low gamma voltage to the medium gamma voltage selector, wherein the high gray scale is defined as a gray scale value greater than or equal to a first predetermined gray scale value, and wherein the low gray scale is defined as a gray scale less than or equal to a second predetermined gray scale value.

In the above gamma voltage generator, the second predetermined gray scale value includes one of a gray scale "0" and a gray scale "3".

In the above gamma voltage generator, the gamma reference voltage selector comprises a resistor string, including a plurality of resistors connected to each other in series, and first to third selectors.

In the above gamma voltage generator, the medium gamma voltage selector comprises a plurality of sub resistor strings configured to voltage-divide the first to third gamma voltages into a plurality of divided voltages based at least in part on the selection signal and a plurality of sub-selectors respectively corresponding to the sub resistor strings, wherein the sub-selectors are configured to select and output a medium gamma voltage from the divided voltages.

In the above gamma voltage generator, the sub resistor strings comprise a first sub resistor string configured to i) generate a plurality of medium gamma voltages corresponding to a gray scale "0", and ii) receive the gamma reference voltage so as to generate a plurality of medium gamma voltages each having a value between the gamma reference voltage and the second gamma voltage.

In the above gamma voltage generator, the medium gamma voltage calculator is further configured to calculate the low gamma voltage according to the following Equation:

$$V = 5.481 - \left(\frac{L}{6.1}\right)^{1/2}$$

where V represents the low gamma voltage and L represents a luminance value corresponding to a corresponding gray scale.

In the above gamma voltage generator, the selection signal comprises a first selection signal configured to select a gamma voltage corresponding to a gray scale "0" and a second selection signal configured to select a gamma voltage corresponding to a gray scale "3".

The above gamma voltage generator further comprises a grayscale voltage generator configured to voltage-divide the medium gamma voltages into a plurality of grayscale voltages.

In the above gamma voltage generator, the grayscale voltage generator is further configured to voltage-divide the medium gamma voltages based at least in part on a plurality of serially connected resistors into the grayscale voltages.

Another aspect is an organic light-emitting diode (OLED) display comprising a gamma reference voltage selector configured to i) receive a gamma reference voltage from a voltage generator, ii) select first to third gamma voltages from a plurality of gamma voltages based at least in part on the gamma reference voltage, and iii) output the selected first to third gamma voltages having values substantially equal to or less than the gamma reference voltage. The display also comprises a medium gamma voltage selector configured to i) receive the first to third gamma voltages from the gamma reference voltage selector and ii) select and output a plurality of medium gamma voltages based at least in part on the first to third gamma voltages. The display further comprises a medium gamma voltage calculator configured to i) receive a plurality of high gamma voltages, corresponding to a high gray scale, from the medium gamma voltage selector, ii) select at least one of the high gamma voltages based at least in part on the first to third gamma voltages so as to calculate a low gamma voltage corresponding to a low gray scale, and iii) output a selection signal corresponding to the calculated low gamma voltage to the medium gamma voltage selector, wherein the high gray scale is defined as a gray scale value greater than or equal to a first predetermined gray scale value, and wherein the low gray scale is defined as a gray scale less than or equal to a second predetermined gray scale value. The display also comprises a grayscale voltage generator configured to voltage-divide the medium gamma voltages to generate a plurality of grayscale voltages. The display also comprises a display panel including a plurality of pixels and a data driver configured to receive the grayscale voltages from the gamma voltage generator and respectively supply data signals, based at least in part on the grayscale voltages, corresponding to an image to be displayed on the display panel.

In the above display, the grayscale voltage generator is further configured to voltage-divide the medium gamma voltages based at least in part on a plurality of serially connected resistors into the grayscale voltages.

In the above display, the second predetermined gray scale value includes one of a gray scale "0" and a gray scale "3".

In the above display, the gamma reference voltage selector comprises a resistor string, including a plurality of resistors connected to each other in series, and first to third selectors.

In the above display, the medium gamma voltage selector comprises a plurality of sub resistor strings configured to voltage-divide the first to third gamma voltages into a plurality of divided voltages based at least in part on the selection signal. In the above display, the medium gamma voltage selector also comprises a plurality of sub-selectors respectively corresponding to the sub resistor strings, wherein the sub-selectors are configured to select and output a medium gamma voltage from the divided voltages.

In the above display, the sub resistor strings comprise a first sub resistor string configured to i) generate a plurality of medium gamma voltages corresponding to a gray scale "0", and ii) receive the gamma reference voltage so as to generate a plurality of medium gamma voltages each having a value between the gamma reference voltage and the second gamma voltage.

In the above display, the medium gamma voltage calculator is further configured to calculate the low gamma voltage according to the following Equation:

$$V = 5.481 - \left(\frac{L}{6.1}\right)^{1/2}$$

where V represents the low gamma voltage and L represents a luminance value corresponding to a corresponding gray scale.

Another aspect is a method of generating a gamma voltage for an organic light-emitting diode (OLED) display comprising a display panel, the method comprising measuring a luminance of the display panel and determining a plurality of high gamma voltages corresponding to a high gray scale, wherein the high gray scale is defined as a gray scale value greater than or equal to a first predetermined gray scale value. The method also comprises selecting at least two high gamma voltages from among the high gamma voltages and calculating a low gamma voltage based at least in part on the selected high gamma voltages, wherein the high gamma voltages are defined as gamma voltages above first predetermined gamma values.

In the above method, the low gamma voltage comprises a voltage corresponding to a gray scale "0" or a gray scale "3".

In the above method, the calculating is performed based on the following Equation:

$$V = 5.481 - \left(\frac{L}{6.1}\right)^{1/2}$$

where V represents the low gamma voltage and L represents a luminance value corresponding to a corresponding gray scale.

The above method further comprises voltage-dividing the high gamma voltages and the low gamma voltage into a plurality of gray voltages.

DETAILED DESCRIPTION OF CERTAIN INVENTIVE EMBODIMENTS

Figures 1, 2:
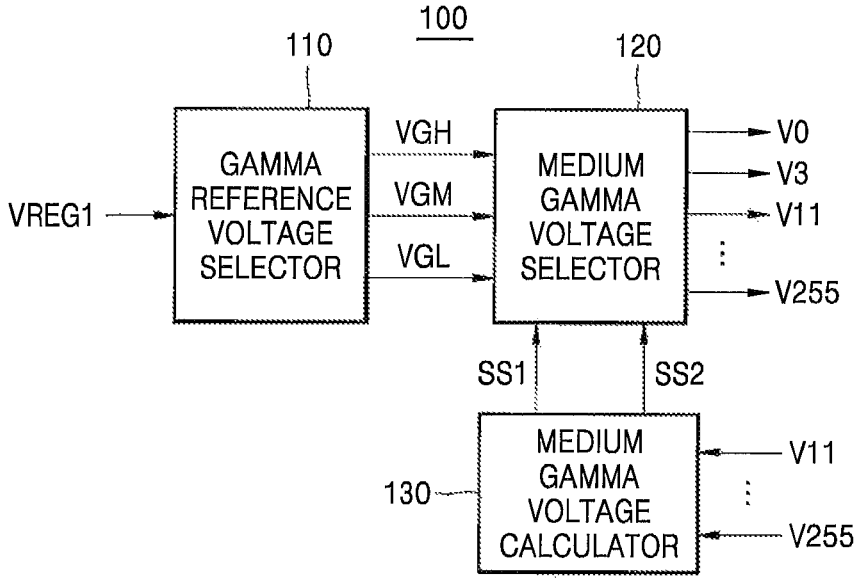
FIG. 1 is a table exemplarily showing a level of a gamma voltage and luminance corresponding to a grayscale level.
FIG. 2 is a diagram schematically illustrating a configuration of a gamma voltage generator according to an exemplary embodiment.

Emission luminance is determined using relative voltages of a display panel driving voltage and analog data (i.e., a grayscale voltage) applied to each pixel. A certain margin is given to a grayscale voltage corresponding to a low gray scale. As the margin increases, the swing of the data voltage increases. For this reason, power consumption increases, and the difference between the target luminance and actual luminance increases.

Reference will now be made in detail to exemplary embodiments, examples of which are illustrated in the accompanying drawings, wherein like reference numerals refer to like elements throughout. In this regard, the present exemplary embodiments can have different forms and should not be construed as being limited to the descriptions set forth herein. Accordingly, the exemplary embodiments are merely described below, by referring to the figures, to explain aspects of the present description.

Embodiments of the described technology can impose various transformations that can have various embodiments, and specific embodiments illustrated in the drawings will be described in detail in the detailed description. The effects and features of the described technology will become apparent from the following description of the embodiments with reference to the accompanying drawings, which is set forth hereinafter. The described technology can, however, can be embodied in different forms and should not be construed as being limited to the embodiments set forth herein.

Hereinafter, a gamma voltage generator and method and an OLED display including the same according to various exemplary embodiments will be described in detail with reference to the accompanying drawings. In addition, in the present specification and drawings, like reference numerals refer to like elements throughout, and thus, redundant descriptions are omitted.

In the following embodiments, the singular forms "a", "an", and "the" are intended to include the plural forms as well, unless the context clearly indicates otherwise. In the following embodiments, it should be further understood that the terms "comprises", "comprising", "has", "having", "includes", and/or "including", when used herein, specify the presence of stated features, integers, steps, operations, elements, and/or components, but do not preclude the presence or addition of one or more other features, integers, steps, operations, elements, components, and/or groups thereof.

In the following embodiments, the terms "first" and "second" are for differentiating one element from another element, and these elements should not be limited by these terms. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a table exemplarily showing a level of a gamma voltage and luminance corresponding to a grayscale level.

In the table of FIG. 1, a first column of represents grayscale levels, a second column represents emission luminance corresponding to gray scales, and a third column represents levels of gamma voltages corresponding to gray scales.

As a grayscale value becomes closer to 0, a color becomes closer to black, and thus, emission luminance is darkened. As a grayscale value becomes closer to 255, a color becomes closer to white, and thus, emission luminance is brightened.

A gamma voltage corresponding to certain luminance can be determined based on luminance which is measured by changing a gamma voltage applied to a display panel. When luminance is low, it is difficult to measure luminance, and thus, a gamma voltage corresponding to low luminance is arbitrarily selected in consideration of the swing of a gamma voltage corresponding to high luminance.

In this case, a margin is added to the arbitrarily selected gamma voltage, but a problem can occur where, as the margin increases, consumption power increases, and the difference between target luminance and actual luminance increases. It is possible to decrease the margin in consideration of the problem, but there is a limitation in displaying accurate luminance in a low gray scale.

FIG. 2 is a diagram schematically illustrating a configuration of a gamma voltage generator 100 according to an exemplary embodiment.

The gamma voltage generator 100 supplies a gamma voltage based on a gamma characteristic of a display panel, and includes a gamma reference voltage selector 110, a medium gamma voltage selector 120, and a medium gamma voltage calculator 130.

The gamma reference voltage selector 110 can include a resistor string (see FIG. 4), in which a plurality of resistors are connected to each other in series, and first to third selectors. The first selector outputs a first gamma voltage VGH, the second selector outputs a second gamma voltage VGM, and the third selector outputs a third gamma voltage VGL.

The gamma reference voltage selector 110 receives a gamma reference voltage VREG1 to select and output the first gamma voltage VGH, the second gamma voltage VGM, and the third gamma voltage VGL which have a voltage value substantially equal to or less than the gamma reference voltage VREG1.

The first gamma voltage VGH, the second gamma voltage VGM, and the third gamma voltage VGL have a voltage value less than or substantially equal to the gamma reference voltage VREG1. A level of the second gamma voltage VGM can be less than that of the first gamma voltage VGH and greater than that of the third gamma voltage VGL.

The medium gamma voltage selector 120 receives the first to third gamma voltages VGH, VGM and VGL to select and output a plurality of medium gamma voltages V0, V3, V11, . . . , V255.

The medium gamma voltages V0, V3, V11, . . . , V255 are grayscale voltages corresponding to individual gray scales which are to be displayed by the display panel, and can be voltage-divided again.

Moreover, the medium gamma voltage calculator 130 receives a plurality of high gamma voltages V11, . . . , V255 corresponding to a high gray scale from the medium gamma voltage selector 120, selects some of the high gamma voltages V11, . . . , V255 to calculate a low gamma voltage corresponding to a low gray scale, and outputs first and second selection signals SS1 and SS2 corresponding to the calculated low gamma voltage to the medium gamma voltage selector 120. In some embodiments, the high gray scale is defined as a gray scale value greater than or equal to a first predetermined gray scale value, and the low gray scale is defined as a gray scale less than or equal to a second predetermined gray scale value. In some embodiments, the high gamma voltages are defined as gamma voltages above first predetermined gamma values.

In a general 8-bit driving display panel, gray scales "0" to "255" can be expressed, and a voltage V0, corresponding to a gray scale "0", to a voltage V255, corresponding to a gray scale "255", can be output as gamma voltages for expressing 256 gray scales.

A gray scale "0" corresponds to black, and a gray scale "255" corresponds to white. As a gray scale becomes less, a grayscale voltage corresponding to the gray scale has a greater value.

In FIG. 2, the medium gamma voltage selector 120 outputs medium gamma voltages V0, V3, V11, V23, V35, V51, V87, V151, V203 and V255.

In FIGS. 1 and 2, the medium gamma voltages V0, V3, V11, V23, V35, V51, V87, V151, V203 and V255 are voltages corresponding to an inflection point of a gamma curve used to drive the display panel, and are not limited to the voltages. The medium gamma voltages can be variously changed according to the inflection point of the gamma curve being changed.

The medium gamma voltage calculator 130 calculates a low gamma voltage corresponding to a low gray scale, and can be the voltage V0 and a voltage V3.

A voltage (i.e., a medium gamma voltage substantially equal to or greater than V11) corresponding to a gray scale "11" among the medium gamma voltages is relatively accurately calculated by measuring luminance and a gamma voltage in corresponding luminance with equipment such as a luminance meter.

However, using measurement equipment, it is difficult to accurately measure medium gamma voltages, corresponding to a low gray scale, such as V0 and V3. A medium gamma voltage substantially equal to or greater than V11 can be set in consideration of a certain margin.

This is selected and determined by a designer. Power consumption increases depending on a level of a margin, and it is unable to accurately express target luminance.

The medium gamma voltage calculator 130 uses a medium gamma voltage substantially equal to or greater than V11 so as to more accurately set medium gamma voltages V0 and V3 corresponding to a low gray scale, and can use the following Equation (1):

$$V = 5.481 - \left(\frac{L}{6.1}\right)^{1/2} \tag{1}$$

where V denotes a low gamma voltage, and L denotes a luminance value corresponding to a low gray scale.

For example, a medium gamma voltage V0 becomes about 5.452 V by substituting 0.005, which is a luminance of a gray scale "0", into L of Equation (1). Also, a medium gamma voltage V3 becomes about 5.428 V by substituting 0.01708, which is a luminance of a gray scale "3", into L of Equation (1).

Equation (1) can be derived from a current equation, such as the following Equation (2), in a saturation region of a P-type MOSFET, $$I = \frac{\beta}{2}(V_s - V_g - V_{th})^2 \tag{2}$$

The following Equation (3) can be derived from Equation (2) by substituting a constant "B" for β/2, substituting a constant "A" for Vs−Vth, and substituting luminance "L" for a current "I".

$$L = B \times (A - V_g)^2 \tag{3}$$

A current flowing in each pixel of the display panel and an emission luminance of a corresponding pixel have a linearly proportional relationship, and thus, the substitution can be performed. Vg is a voltage applied to a gate of a driving transistor included in each pixel, and is a data voltage based on a grayscale level.

In the table of FIG. 1, by substituting luminance "0.29771 nit" and a corresponding voltage V11 "5.253 V" into Equation (3) and substituting luminance "1.50846 nit" and a corresponding voltage V23 "5.064 V" into Equation (3), the constant "A" is calculated as about 5.481, and the constant "B" is calculated as about 6.1 using a system of equations. Equation (1) is obtained by rearranging Equation (3) about a voltage.

The constants "A" and "B" can be derived by two medium gamma voltages, which are selected from among a plurality of high grayscale medium gamma voltages output from the medium gamma voltage selector 120, except V11 and V23.

That is, the medium gamma voltage calculator 130 calculates a medium gamma voltage corresponding to a low gray scale by using a medium gamma voltage corresponding to a high gray scale which enables a relatively accurate gamma voltage to be measured by the luminance measurement equipment.

Moreover, the medium gamma voltage calculator 130 outputs the first and second selection signals SS1 and SS2 which allow the calculated medium gamma voltage to be selected by the medium gamma voltage selector 120.

Figure 3:
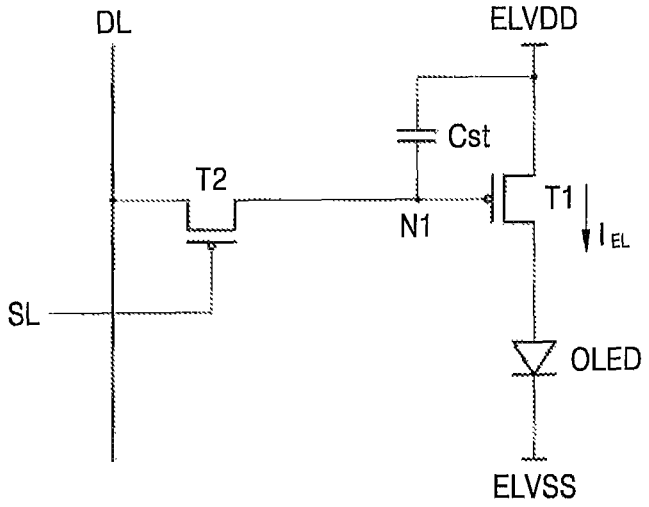
FIG. 3 is a circuit diagram illustrating a pixel of a display panel.

FIG. 3 is a circuit diagram illustrating a pixel of a display panel.

Referring to FIG. 3, the pixel includes a driving transistor T1, a switching transistor T2, a storage capacitor Cst, and an organic light-emitting diode OLED.

The switching transistor T2 includes a source electrode connected to a data line DL, a drain electrode connected to a gate electrode of the driving transistor T1, and a gate electrode connected to a scan line SL. When the switching transistor T2 is turned on, the switching transistor T2 transfers a data signal to the driving transistor T1. Here, the data signal is a gamma voltage.

The driving transistor T1 includes a source electrode connected to a driving voltage ELVDD and a drain electrode connected to an anode electrode of the OLED. The driving transistor T1 adjusts an amount of a driving current $I_{EL}$ in correspondence with the driving voltage ELVDD and a voltage of a first node N1.

The storage capacitor Cst includes a first electrode connected to the driving voltage ELVDD and a second electrode connected to the first node N1 and stores a voltage corresponding to a voltage difference between the driving voltage ELVDD and the data signal.

The OLED includes the anode electrode connected to the drain electrode of the driving transistor T1, a cathode electrode connected to a ground voltage ELVSS, and a plurality of emission layers that emit light in correspondence with a level of the driving current $I_{EL}$.

Figure 4:
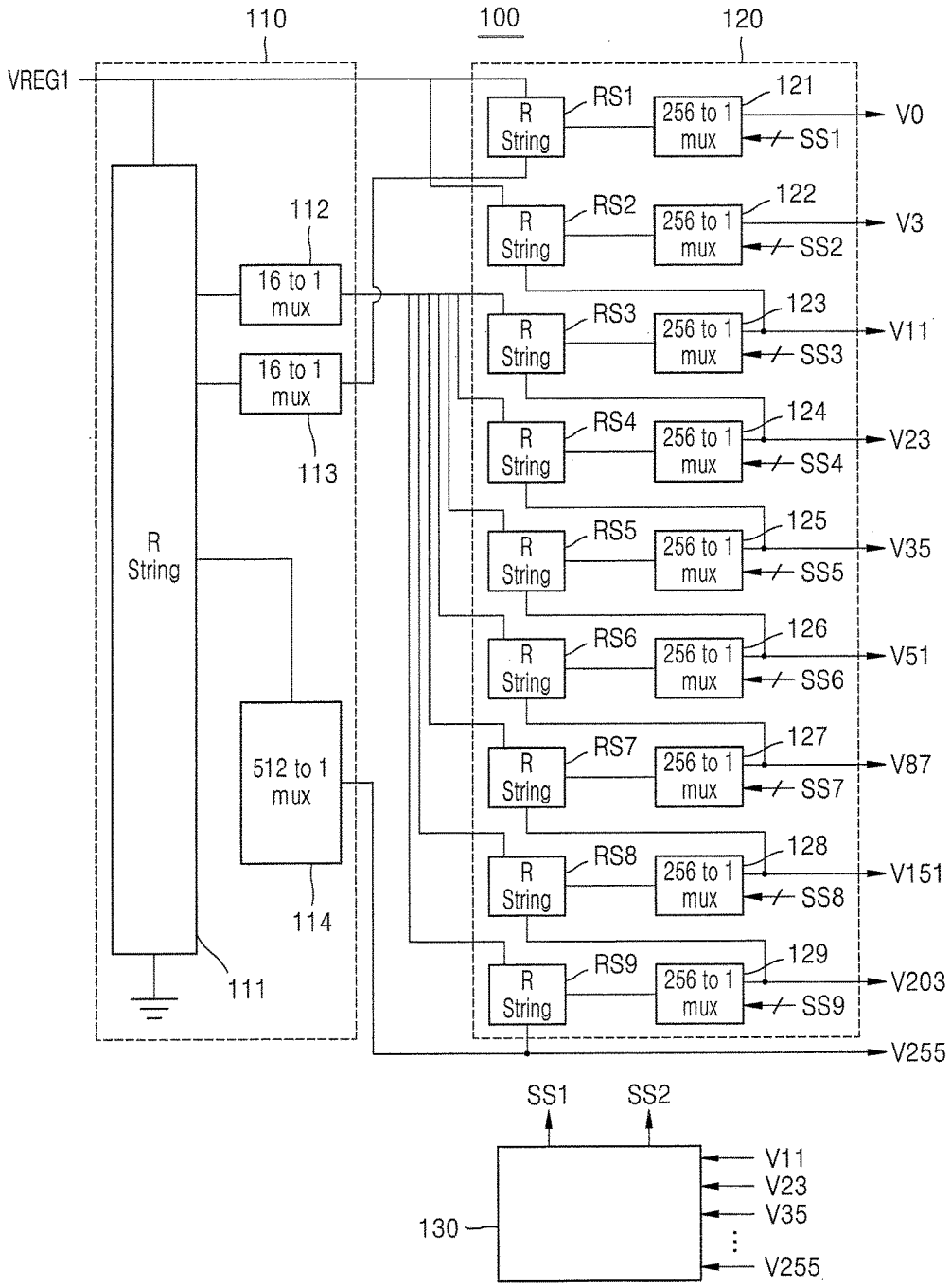
FIG. 4 is a diagram schematically illustrating a configuration of a gamma voltage generator according to an exemplary embodiment.

FIG. 4 is a diagram schematically illustrating a configuration of a gamma voltage generator 100 according to an exemplary embodiment.

Referring to FIG. 4, the gamma voltage generator 100 is substantially the same as the gamma voltage generator 100 described above with reference to FIG. 2, and each element is illustrated in detail.

The gamma reference voltage selector 110 can include a main resistor string 111, in which a plurality of resistors are connected to each other in series, and first to third selectors 112 to 114.

Each of the first to third selectors 112 to 114 illustrated in FIG. 4 is illustrated as a 16:1 multiplexer or a 512:1 multiplexer, but is not limited thereto.

The first selector 112 is connected to a side close to the gamma reference voltage VREG1 in the main resistor string 111 and outputs the first gamma voltage VGH.

The third selector 114 is connected to a side far away from the gamma reference voltage VREG1 in the main resistor string 111 and outputs the third gamma voltage VGL.

The second selector 112 is formed between the first selector 112 and the third selector 114 in the main resistor string 111, and outputs the second gamma voltage VGM.

Therefore, the first gamma voltage VGH has a value less than the gamma reference voltage VREG1 and greater than the second gamma voltage VGM, and the third gamma voltage VGL has a value less than the second gamma voltage VGM.

The medium gamma voltage selector 120 includes a plurality of sub resistor strings RS1 to RS9 and a plurality of sub-selectors 121 to 129 that respectively match the sub resistor strings RS1 to RS9 and select and output a medium gamma voltage from among voltages divided by the sub resistor strings RS1 to RS9 according to selection signals SS1 to SS9.

Each of first to ninth sub resistor strings RS1 to RS9 includes a plurality of resistors connected to each other in series and can generate a plurality of voltages according to a voltage drop across the resistors.

One voltage is selected from among the voltages by the sub-selectors 121 to 129, which correspond to the first to ninth sub resistor strings RS1 to RS9 in an one-to-one relationship, and is output as the medium gamma voltage.

Each of the sub-selectors 121 to 129 is illustrated as a 256:1 multiplexer, but is not limited thereto.

A high voltage is supplied to the third to ninth sub resistor strings RS3 to RS9, corresponding to the third to ninth sub-selectors 123 to 129 which output medium gamma voltages V11 to V255 corresponding to a high gray scale, according to the first gamma voltage VGH output from the first selector 112.

The third gamma voltage VGL output from the third selector 114 corresponds to a medium gamma voltage V255 corresponding to a gray scale "255", and a low voltage is supplied to the ninth sub resistor string RS9 according to the third gamma voltage VGL.

An nth medium gamma voltage output from an nth sub-selector in the medium gamma voltage selector 120 of FIG. 4 is applied as a low voltage to an n−1st sub resistor string. Therefore, the nth medium gamma voltage has a value lower than an n−1st medium gamma voltage (where n is an integer value which is equal to or more than three and equal to or less than nine).

The gamma reference voltage VREG1 is supplied as a high voltage to the first sub resistor string RS1 and the second sub resistor string RS2. The second gamma voltage VGM is supplied as a low voltage of the first sub resistor string RS1.

Therefore, a medium gamma voltage V0 which is selected and output by the first sub-selector 121 has a value between the gamma reference voltage VREG1 and the second gamma voltage VGM.

The medium gamma voltage V0 which is selected and output by the first sub-selector 121 is calculated from two medium gamma voltages selected from among medium gamma voltages V11, V23, V35, V51, V87, V151, V203 and V255 which are selected and output by the third to ninth sub-selectors 123 to 129.

When the gamma reference voltage VREG1 is used as the medium gamma voltage V0 as is, levels of the other medium gamma voltages V3, V11, V23, V35, V51, V87, V151, V203 and V255 can be changed according to a level of the medium gamma voltage V0.

The gamma voltage generator 100 according to an exemplary embodiment controls the level of the medium gamma voltage V0, and thus allows levels of the other medium gamma voltages V3, V11, V23, V35, V51, V87, V151, V203 and V255 to not be changed despite the level of the medium gamma voltage V0 being changed.

The gamma voltage V3 which is selected and output by the second sub-selector 122 has a value between the gamma reference voltage VREG1 and the gamma voltage V11 which is selected and output by the third sub-selector 123.

The sub-selectors 121 to 129 respectively receive the selection signals SS1 to SS9 for selecting a medium gamma voltage. A first selection signal SS1 for selecting V0 and a second selection signal SS2 for selecting V3 are supplied from the medium gamma voltage 130.

The selection signals SS3 to SS9 for selecting V11 to V255 can be supplied from a separate controller (not shown), or can be supplied from the medium gamma voltage calculator 130.

The medium gamma voltages V0, V3, V11, V23, V35, V51, V87, V151, V203 and V255 form an inflection point of a gamma curve used to drive the display panel, and a gamma voltage value between the medium gamma voltages can be linearly selected two medium gamma voltages.

A case in which the number of medium gamma voltages output from the medium gamma voltage selector 120 is nine has been described as an example, but the number of the medium gamma voltages can be changed according to the display characteristics.

Moreover, the number of the sub resistor strings and the number of the sub-selectors can be changed based on the number of the medium gamma voltages.

Figure 5A:
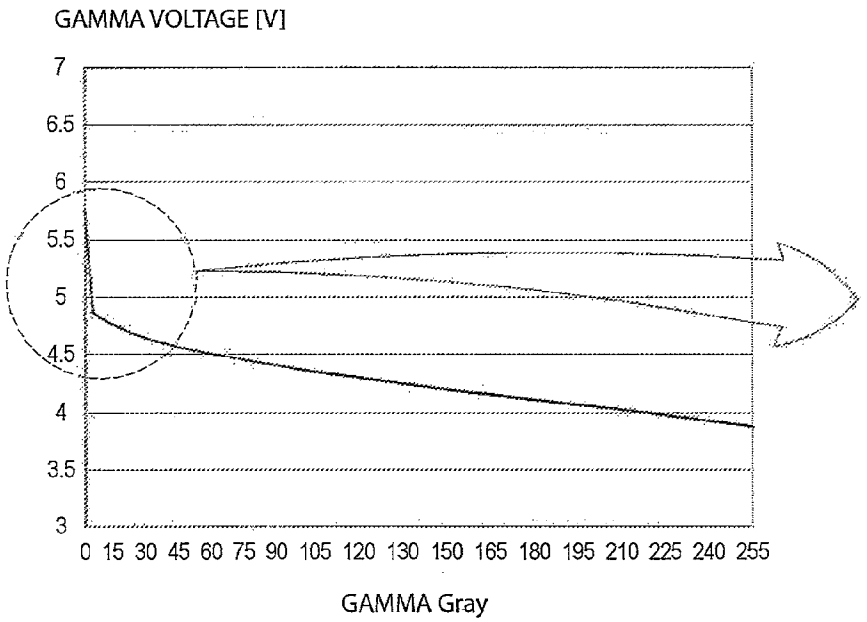
FIGS. 5(*a*) and 5(*b*) are diagrams showing gamma curves obtained by using the gamma voltage generator according to an exemplary embodiment.
Figure 5B:
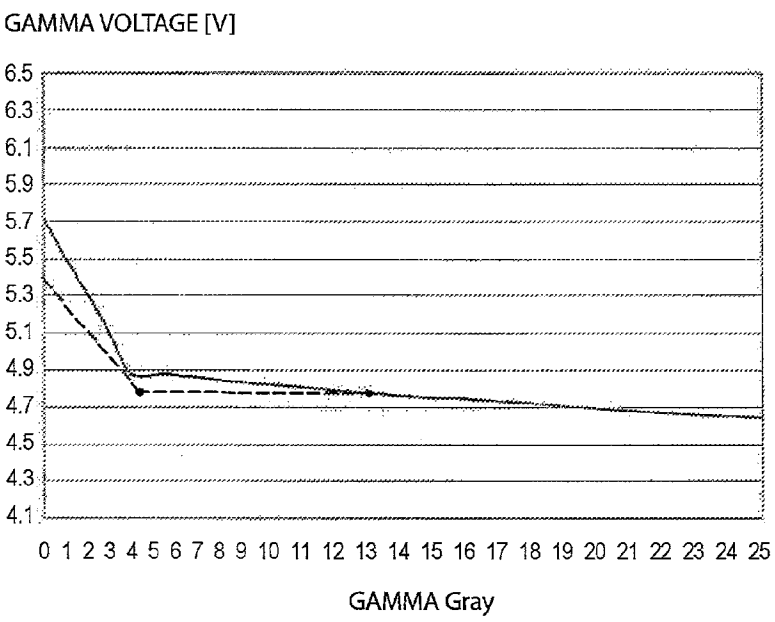

FIGS. 5(*a*) and 5(*b*) are diagrams showing gamma curves obtained by using the gamma voltage generator according to an exemplary embodiment.

FIG. 5(*a*) shows a gamma curve corresponding to gamma voltages shown in the table of FIG. 1. FIG. 5(*b*) shows a gamma curve corresponding to gamma voltages generated by the gamma voltage generator 100.

Compared to an improved gamma curve shown in FIG. 5(*b*), a typical gamma curve shown in FIG. 5(*a*) has a greater gamma voltage in a low grayscale region. This is because a certain margin is given to a gamma voltage corresponding to a low grayscale region which is difficult to accurately measure luminance in the display panel, and can become the cause of a problem in which power consumption increases and display luminance is inaccurate.

The improved gamma curve is a gamma curve which is calculated by using a low grayscale gamma voltage which is calculated by using a gamma voltage corresponding to a high gray scale, and solves the above-described problem by decreasing a margin in a low grayscale region compared to the related art gamma curve.

Figure 6:
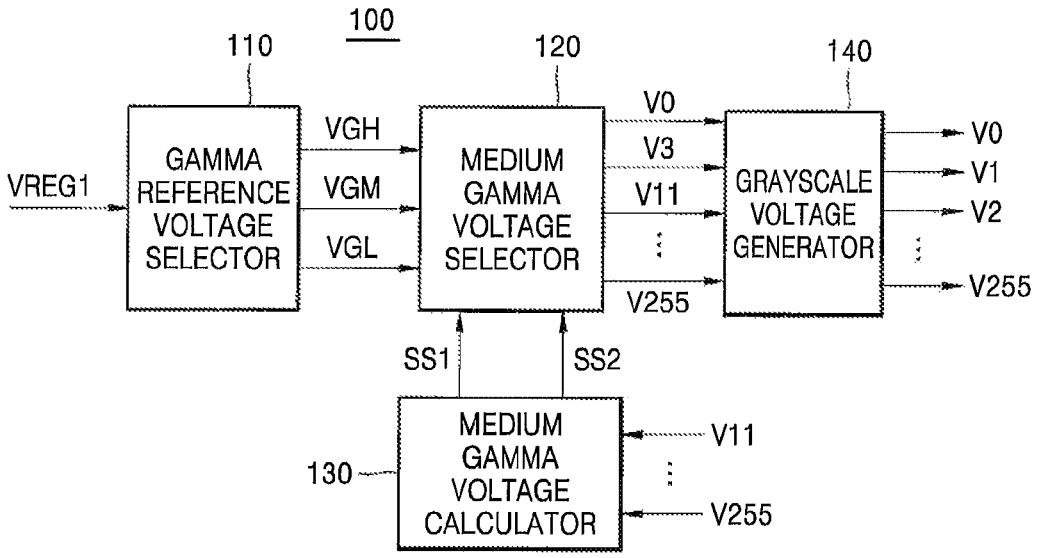
FIG. 6 is a diagram schematically illustrating a configuration of a gamma voltage generator according to another exemplary embodiment.

FIG. 6 is a diagram schematically illustrating a configuration of a gamma voltage generator 100' according to another exemplary embodiment.

The gamma voltage generator 100' according to another exemplary embodiment further includes a grayscale voltage generator 140 which is not disclosed in the gamma voltage generator 100 described above with reference to FIG. 2.

The grayscale voltage generator 140 voltage-divides the medium gamma voltages V0, V3, V11, V23, V35, V51, V87, V151, V203 and V255 to generate a plurality of grayscale voltages V0 to V255. The medium gamma voltages are output from the medium gamma voltage selector 120 and are supplied to the grayscale voltage generator 140.

The grayscale voltage generator 140 can include a resistor string (not shown) in which a plurality of resistors for voltage-dividing the medium gamma voltages are connected to each other in series, and the grayscale voltages V0 to V255 can be linearly calculated from the medium gamma voltages V0, V3, V11, V23, V35, V51, V87, V151, V203 and V255.

For example, a grayscale voltage V1 corresponding to a gray scale "1" and a grayscale voltage V2 corresponding to a gray scale "2" can be generated by dividing, into three equal parts, the difference between the medium gamma voltage V0 and the medium gamma voltage V3.

Figure 7:
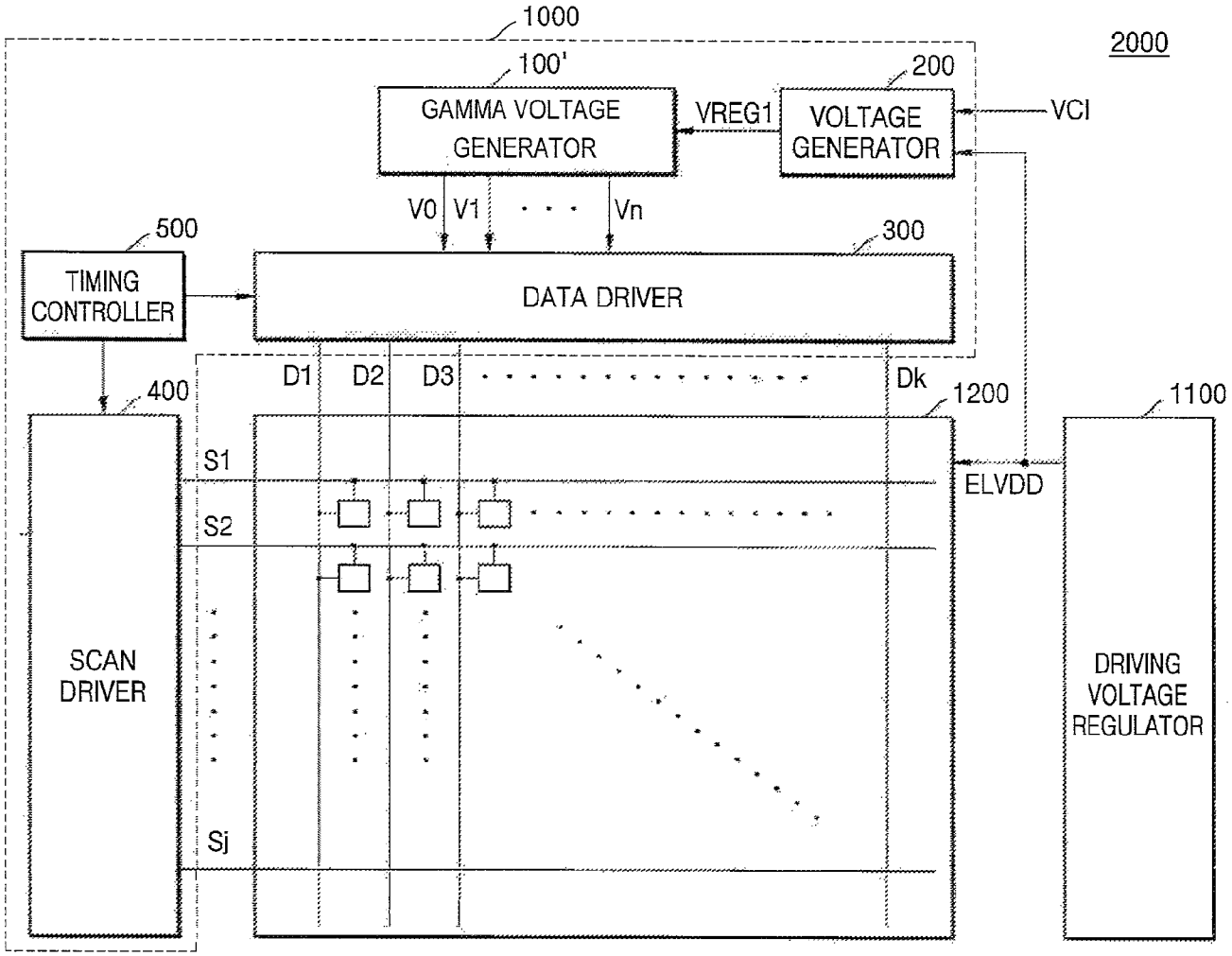
FIG. 7 is a diagram schematically illustrating a configuration of an OLED display including a gamma voltage generator according to an exemplary embodiment.

FIG. 7 is a diagram schematically illustrating a configuration of an OLED display 2000 including a gamma voltage generator according to an exemplary embodiment.

Referring to FIG. 7, the OLED display 2000 includes a gamma voltage generator 100', a display panel 1200 including a plurality of pixels, and a data driver 300.

The gamma voltage generator 100' and the data driver 300 can configure a display driving apparatus or display driver 1000 along with a voltage generator 200, a scan driver 400, and a timing controller 500. The OLED display 2000 can further include a driving voltage regulator 1100.

The gamma voltage generator 100' includes the gamma reference voltage selector 110, the medium gamma voltage selector 120, the medium gamma voltage calculator 130, and the grayscale voltage generator 140 which are as described above with reference to FIGS. 5(*a*) and 5(*b*).

The pixels are arranged in the display panel 1200, and each of the pixels includes an OLED which emits light in response to a flow of a current. Each pixel can be the pixel illustrated in FIG. 2. j number of scan lines S1 to Sj can be used to transfer a scan signal in a row direction and k number of data lines D1 to Dk to transfer data signals in a column direction can be arranged in the display panel 1200.

The data driver 300 receives a plurality of grayscale voltages V0 to Vn from the gamma voltage generator 100' to supply grayscale voltages (i.e., data signals), corresponding to an image which is to be displayed by the display panel 1200, to the pixels.

The driving voltage regulator 1100 generates a driving voltage ELVDD and supplies the driving voltage ELVDD to the display panel 1200 and the display driving apparatus 1000.

The voltage generator 200 receives a source voltage VCI and a driving voltage ELVDD to generate a gamma reference voltage VREG1 and transfers the gamma reference voltage VREG1 to the gamma voltage generator 100 or 100'.

The data driver 300 selects grayscale voltages corresponding to display data according to a control signal supplied from the timing controller 500 and respectively outputs the grayscale voltages to the data lines D1 to Dk of the display panel 1200.

The scan driver 400 is connected to the scan lines S1 to Sj of the display panel 1200 and transfers the scan signal to a certain row of the display panel 1200. A data signal (i.e., a grayscale voltage) output from the data driver 300 is transferred to a pixel receiving the scan signal.

Figure 8:
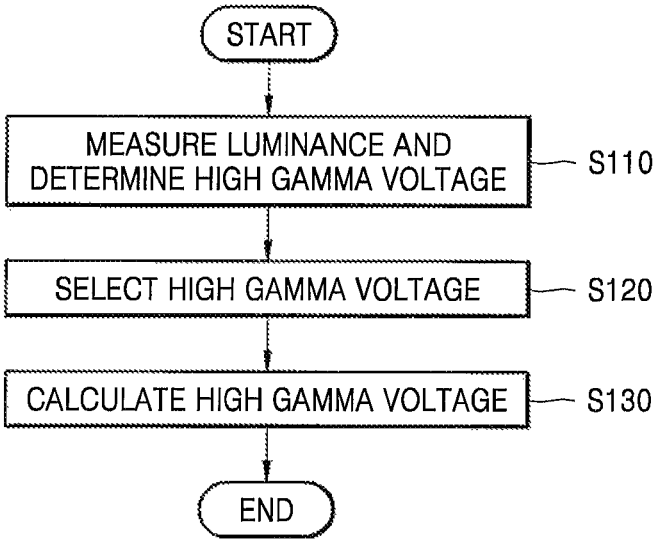
FIG. 8 is a flowchart illustrating a gamma voltage generating method according to an exemplary embodiment.

FIG. 8 is a flowchart illustrating a gamma voltage generating method according to an exemplary embodiment. In some embodiments, the FIG. 8 procedure is implemented in a conventional programming language, such as C or C++ or another suitable programming language. The program can be stored on a computer accessible storage medium of display device 2000, for example, a memory (not shown) of the display driver 1000 or the gamma voltage generator 100. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 7.

The gamma voltage generating method is a gamma voltage generating method of supplying a gamma voltage based on a gamma characteristic of a display panel and includes operation S110 of measuring a luminance of the display panel and determining a plurality of high gamma voltages corresponding to a high gray scale. The method also includes an operation S120 of selecting at least two high gamma voltages from among the high gamma voltages and operation S130 of calculating a low gamma voltage by using the selected at least two high gamma voltages.

In operation S110, a gamma voltage based on each luminance is determined by changing a luminance of a display panel for obtaining a relationship between a gray scale, luminance, and a gamma voltage shown in the table of FIG. 1.

In this case, a gamma voltage corresponding to low luminance (i.e., a low gray scale) is not determined, and a gamma voltage corresponding to high luminance (i.e., a high gray scale) is not determined. The gamma voltage corresponding to low luminance can include the gamma voltage V0 corresponding to a gray scale "0" and the gamma voltage V3 corresponding to a gray scale "3".

In operation S120, at least two high gamma voltages are selected for calculating the gamma voltage (i.e., a low gamma voltage) corresponding to a low gray scale. The at least two high gamma voltages which are selected in operation S120 are selected from among the high gamma voltages which are determined in operation S110.

In operation S130, the low gamma voltage can be calculated by using Equation (1):

$$V = 5.481 - \left(\frac{L}{6.1}\right)^{1/2} \tag{1}$$

where V denotes a low gamma voltage, and L denotes a luminance value corresponding to a corresponding gray scale.

A gamma voltage generating method according to another exemplary embodiment can further include an operation of voltage-dividing the high gamma voltages and the low gamma voltage to generate a plurality of gray voltages.

As described above, according to the one or more of the above exemplary embodiments, provided are a gamma voltage generator, method of using the same, and an OLED display including the generator, which generates a gamma voltage that enables light, having luminance close to target luminance, to be emitted in a low gray scale.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While the inventive technology has been described with reference to the figures, it will be understood by those of ordinary skill in the art that various changes in form and details can be made therein without departing from the spirit and scope as defined by the following claims.

What is claimed is:

1. A gamma voltage generator for an organic light-emitting diode (OLED) display, comprising:

a gamma reference voltage selector configured to i) receive a gamma reference voltage from a voltage generator, ii) select first to third gamma voltages from a plurality of gamma voltages based at least in part on the gamma reference voltage, and iii) output the selected first to third gamma voltages having values substantially equal to or less than the gamma reference voltage;

a medium gamma voltage selector configured to i) receive the first to third gamma voltages from the gamma reference voltage selector and ii) select and output a plurality of medium gamma voltages based at least in part on the first to third gamma voltages; and a medium gamma voltage calculator configured to i) receive a plurality of high gamma voltages, corresponding to a high gray scale, from the medium gamma voltage selector, ii) select at least one of the high gamma voltages based at least in part on the first to third gamma voltages so as to calculate a low gamma voltage corresponding to a low gray scale, and iii) output a selection signal corresponding to the calculated low gamma voltage to the medium gamma voltage selector, wherein the high gray scale is defined as a gray scale value greater than or equal to a first predetermined gray scale value, and wherein the low gray scale is defined as a gray scale less than or equal to a second predetermined gray scale value.

2. The gamma voltage generator of claim 1, wherein the second predetermined gray scale value includes one of a gray scale "0" and a gray scale "3".

3. The gamma voltage generator of claim 1, wherein the gamma reference voltage selector comprises a resistor string, including a plurality of resistors connected to each other in series, and first to third selectors.

4. The gamma voltage generator of claim 1, wherein the medium gamma voltage selector comprises:

a plurality of sub resistor strings configured to voltage-divide the first to third gamma voltages into a plurality of divided voltages based at least in part on the selection signal; and a plurality of sub-selectors respectively corresponding to the sub resistor strings, wherein the sub-selectors are configured to select and output a medium gamma voltage from the divided voltages.

5. The gamma voltage generator of claim 4, wherein the sub resistor strings comprise a first sub resistor string configured to i) generate a plurality of medium gamma voltages corresponding to a gray scale "0", and ii) receive the gamma reference voltage so as to generate a plurality of medium gamma voltages each having a value between the gamma reference voltage and the second gamma voltage.

6. The gamma voltage generator of claim 1, wherein the medium gamma voltage calculator is further configured to calculate the low gamma voltage according to the following Equation:

$$V = 5.481 - \left(\frac{L}{6.1}\right)^{1/2}$$

where V represents the low gamma voltage and L represents a luminance value corresponding to a corresponding gray scale.

7. The gamma voltage generator of claim 1, wherein the selection signal comprises a first selection signal configured to select a gamma voltage corresponding to a gray scale "0" and a second selection signal configured to select a gamma voltage corresponding to a gray scale "3".

8. The gamma voltage generator of claim 1, further comprising a grayscale voltage generator configured to voltage-divide the medium gamma voltages into a plurality of grayscale voltages.

9. The gamma voltage generator of claim 8, wherein the grayscale voltage generator is further configured to voltage-divide the medium gamma voltages based at least in part on a plurality of serially connected resistors into the grayscale voltages.

10. An organic light-emitting diode (OLED) display comprising:

a gamma reference voltage selector configured to i) receive a gamma reference voltage from a voltage generator, ii) select first to third gamma voltages from a plurality of gamma voltages based at least in part on the gamma reference voltage, and iii) output the selected first to third gamma voltages having values substantially equal to or less than the gamma reference voltage;

a medium gamma voltage selector configured to i) receive the first to third gamma voltages from the gamma reference voltage selector and ii) select and output a plurality of medium gamma voltages based at least in part on the first to third gamma voltages; and a medium gamma voltage calculator configured to i) receive a plurality of high gamma voltages, corresponding to a high gray scale, from the medium gamma voltage selector, ii) select at least one of the high gamma voltages based at least in part on the first to third gamma voltages so as to calculate a low gamma voltage corresponding to a low gray scale, and iii) output a selection signal corresponding to the calculated low gamma voltage to the medium gamma voltage selector, wherein the high gray scale is defined as a gray scale value greater than or equal to a first predetermined gray scale value, and wherein the low gray scale is defined as a gray scale less than or equal to a second predetermined gray scale value;

a grayscale voltage generator configured to voltage-divide the medium gamma voltages to generate a plurality of grayscale voltages;

a display panel including a plurality of pixels; and a data driver configured to receive the grayscale voltages from the gamma voltage generator and respectively supply data signals, based at least in part on the grayscale voltages, corresponding to an image to be displayed on the display panel.

11. The OLED display of claim 10, wherein the gray scale voltage generator is further configured to voltage-divide the medium gamma voltages based at least in part on a plurality of serially connected resistors into the grayscale voltages.

12. The OLED display of claim 10, wherein the second predetermined gray scale value includes one of a gray scale "0" and a gray scale "3".

13. The OLED display of claim 10, wherein the gamma reference voltage selector comprises a resistor string, including a plurality of resistors connected to each other in series, and first to third selectors.

14. The OLED display of claim 10, wherein the medium gamma voltage selector comprises:

a plurality of sub resistor strings configured to voltage-divide the first to third gamma voltages into a plurality of divided voltages based at least in part on the selection signal; and a plurality of sub-selectors respectively corresponding to the sub resistor strings, wherein the sub-selectors are configured to select and output a medium gamma voltage from the divided voltages.

15. The OLED display of claim 14, wherein the sub resistor strings comprise a first sub resistor string configured to i) generate a plurality of medium gamma voltages corresponding to a gray scale "0", and ii) receive the gamma reference voltage so as to generate a plurality of medium gamma voltages each having a value between the gamma reference voltage and the second gamma voltage.

16. The OLED display of claim 10, wherein the medium gamma voltage calculator is further configured to calculate the low gamma voltage according to the following Equation:

$$V = 5.481 - \left(\frac{L}{6.1}\right)^{1/2}$$

where V represents the low gamma voltage and L represents a luminance value corresponding to a corresponding gray scale.

17. A method of generating a gamma voltage for an organic light-emitting diode (OLED) display comprising a display panel, the method comprising:

selecting first to third gamma voltages from a plurality of gamma voltages based at least in part on a gamma reference voltage;

selecting and outputting a plurality of medium gamma voltages based at least in part on the first to third gamma voltages;

measuring a luminance of the display panel and determining a plurality of high gamma voltages corresponding to a high gray scale, wherein the high gray scale is defined as a gray scale value greater than or equal to a first predetermined gray scale value;

selecting at least two high gamma voltages from among the high gamma voltages higher than the medium gamma voltages; and calculating a low gamma voltage based at least in part on the selected high gamma voltages, wherein the high gamma voltages are defined as gamma voltages above first predetermined gamma values.

18. The method of claim 17, wherein the low gamma voltage comprises a voltage corresponding to a gray scale "0" or a gray scale "3".

19. The method of claim 17, wherein the calculating is performed based on the following Equation:

$$V = 5.481 - \left(\frac{L}{6.1}\right)^{1/2}$$

where V represents the low gamma voltage and L represents a luminance value corresponding to a corresponding gray scale.

20. The method of claim 17, further comprising voltage-dividing the high gamma voltages and the low gamma voltage into a plurality of gray voltages.

* * * * *